US005165563A

United States Patent [19]

McKendry

[11] Patent Number: 5,165,563

[45] Date of Patent: Nov. 24, 1992

[54] CHEMOTHERAPY WASTE CONTAINER COVER

[75] Inventor: Jon J. McKendry, Evanston, Ill.

[73] Assignee: Baxter International Inc., Deerfield, Ill.

[21] Appl. No.: 776,149

[22] Filed: Oct. 15, 1991

[51] Int. Cl.[5] ..... B65D 41/04; B65D 51/18

[52] U.S. Cl. ..... 220/254; 220/288; 220/290; 220/306; 220/356; 220/379; 220/908; 206/366

[58] Field of Search ..... 220/212, 254, 256, 288, 220/290, 306, 356, 361, 375, 379, 908; 206/366, 370

[56] References Cited

U.S. PATENT DOCUMENTS

| | | | |
|---|---|---|---|
| D. 287,756 | 1/1987 | Szablak et al. | D24/99 |
| 3,362,564 | 1/1968 | Mueller . | |
| 4,449,640 | 5/1984 | Finkelstein | 220/270 |
| 4,453,648 | 6/1984 | Harris et al. | 220/324 |
| 4,466,538 | 8/1984 | Gianni | 206/366 |
| 4,485,918 | 12/1984 | Mayer | 206/366 |
| 4,488,643 | 12/1984 | Pepper | 206/366 |
| 4,494,652 | 1/1985 | Nelson et al. | 206/366 |
| 4,518,094 | 5/1985 | Kodman | 220/254 |
| 4,520,926 | 6/1985 | Nelson | 206/366 |
| 4,552,280 | 11/1985 | Owen et al. | 220/348 X |
| 4,576,281 | 3/1986 | Kirksey | 206/370 |
| 4,580,688 | 4/1986 | Harris et al. | 220/256 X |
| 4,600,112 | 7/1986 | Shillington et al. | 215/274 |
| 4,610,667 | 9/1986 | Pedicano et al. | 604/192 |
| 4,623,336 | 11/1986 | Pedicano et al. | 604/192 |
| 4,657,139 | 4/1987 | Hanifl | 220/336 |
| 4,667,821 | 5/1987 | Shillington | 206/366 |
| 4,736,860 | 4/1988 | Bemis | 220/252 X |
| 4,779,728 | 10/1988 | Hanifl et al. | 206/366 |
| 4,804,850 | 2/1989 | Schuh et al. | 206/366 |
| 4,809,850 | 3/1989 | Laible et al. | 206/366 |
| 4,819,829 | 4/1989 | Rosten et al. | 220/346 |
| 4,828,107 | 5/1989 | Spencer | 206/366 |
| 4,842,138 | 6/1989 | Sandel et al. | 206/370 |
| 4,862,573 | 9/1989 | Kelson et al. | 206/366 X |
| 4,874,103 | 10/1989 | Quisenberry et al. | 206/366 X |
| 4,898,295 | 2/1990 | Kim | 220/379 X |
| 4,911,315 | 3/1990 | Shrum | 215/229 |

OTHER PUBLICATIONS

Osha Work-Practice Guidelines for Personnel Dealing with Cytotoxic (antineoplastic) Drugs, 43 American Journal of Hospital Pharmacy 5 (May 1985) Winfield Circular.

*Primary Examiner*—Stephen Marcus
*Assistant Examiner*—Vanessa Caretto
*Attorney, Agent, or Firm*—Paul E. Schaafsma; Amy L. H. Rockwell; Paul C. Flattery

[57] ABSTRACT

A cover 10 for a waste disposal container 12 is disclosed. The cover 10 includes a body configured to cover an opening 68 defined by a waste disposal container 12. The body 14 has an orifice 20 therethrough for permitting access to a waste disposal container 12 upon which the cover 10 is placed. A lid 26 is threadably removably attachable to the body 14 for blocking the orifice 20 and preventing access to a waste disposal container 12 upon which the cover 10 is placed. A plurality of posts 36,38,40,42 are provided on the top 16 of the planar body 14 for releasably holding the lid 26 in a fixed storage position on the body when the lid 26 is not in its operative position of the body.

20 Claims, 2 Drawing Sheets

CHEMOTHERAPY WASTE CONTAINER COVER

BACKGROUND OF THE INVENTION

1. Technical Field

The present invention relates generally to receptacles for hazardous waste and, more particularly, to a cover for a container for receiving antineoplastic or chemotherapy wastes generated by health care facilities.

2. Background Art

Antineoplastic or chemotherapy wastes are inherently toxic and present a significant risk of injury to people handling such wastes. A thorough description of the dangers of contact with chemotherapy wastes and recommendations for the proper handling of chemotherapy drugs and wastes are contained in *OSHA Work-Practice Guidelines for Personnel Dealing with Cytotoxic (Antineoplastic) Drugs,* 43 Am. J. Hosp. Phar. 1193 (May 1986).

The prior art has recognized the need to provide appropriate receptacles for confining chemotherapy waste for disposal. One problem the prior art has attempted to address is that of maintaining the receptacle lid with the receptacle to prevent its loss and to prevent it from being set down by a user and contaminating surrounding surfaces. One such receptacle is distributed under the trademark WINFIELD. It consists of an essentially rectangular box-like structure having an annular orifice at the top. A cap is provided which snap fits over the annular opening. The cap is attached to the receptacle by a cord or tie to keep the lid with the receptacle when it is not disposed over the orifice. A similar structure for maintaining a lid with a waste receptacle is shown in U.S. Pat. No. 4,494,652 to Nelson et al. and U.S. Pat. No. 4,520,926 to Nelson.

While these structures provide a device for keeping the lid with the receptacle, they do not fully address the problem of preventing chemotherapy waste from contaminating surrounding surfaces. Once the lid is removed from the receptacle and allowed to dangle therefrom, chemotherapy waste which may have splashed onto the receptacle lid may drip from the receptacle lid onto a surface upon which the chemotherapy waste receptacle rests, or the chemotherapy waste may drip down the side of the receptacle, creating an opportunity for those handling the receptacles to contact chemotherapy waste residue. In addition, the lids for these receptacles must be tied to the receptacle, an additional manufacturing step increasing the cost of the receptacles.

U.S. Pat. No. 4,552,280 to Owens et al. discloses a structure for maintaining a lid on a cover for a hazardous waste receptacle. The lid has a pair of diverging wings which slidably engage a pair of rails on the cover for blocking an orifice in the cover. The orifice is accessed by pulling the lid from the orifice and sliding the diverging wings along the rails. While this structure addresses the problem of the chemotherapy waste container lid permitting chemotherapy waste to drip into the surrounding environment or down the sides of the receptacle from the lid, it is a complicated and expensive structure to manufacture.

SUMMARY OF THE INVENTION

The present invention is directed toward overcoming one or more of the problems discussed above.

The present invention is a cover for a waste disposal container. The cover includes a body having a top and a bottom. The body has an orifice therethrough for permitting access to a waste disposal container upon which the cover is placed. A lid is removably attachable to the body in an operative position for blocking the orifice and preventing access to a waste disposal container upon which the cover is placed. A structure is provided on the body releasably holding the lid in a storage position on the body when the lid is not in its operative position on the body to prevent inadvertent separation of the lid from the body.

The above-described cover can be used with a waste disposal container of the type having a bottom wall and a side wall having a downward turned rim defining an opening. The body is configured to fit over the opening of the waste disposal container. The cover includes a structure for cooperatively grasping the downward turned rim and forming an air and liquid tight seal between the body and the waste disposal container. The structure for cooperatively grasping the downward turned rim can be a downward extending lip on the bottom of the body, the lip having at least one inward projecting flange thereon for engaging a forward portion of the downward turned rim on the waste disposal container. The structure for cooperatively grasping the downward turned rim may also include a plurality of bumpers extending downward from the bottom of the body, the bumpers being configured to engage a back portion of the downward turned rim on the waste container so that the downward turned rim is secured between the downward extending lip, the flange and the bumper.

The cooperating structure on the body and the lid for removably attaching the lid to the body can be an upward extending, outward threaded annular collar around the periphery of the orifice and a cooperating internally threaded downward extending annular wall on the lid.

The structure on the planar body for releasably holding the lid can be at least one post, the lid being engaged to the post by fitting the lid over the post and pushing the lid toward the body. The structure on the planar body holding the lid in a storage position may include a plurality of posts, each post having teeth configured to engage the internally threaded downward extending annular wall on the lid. The teeth may be configured to threadably engage the internally threaded downward extending annular wall on the lid.

The chemotherapy waste container cover of the present invention may be securely and essentially non-removably attached to a chemotherapy waste container for covering the chemotherapy waste container. The cover provides a liquid and air tight seal between the cover and the container to confine waste products. The posts provided on the top of the cover provide a convenient and secure device for holding a lid on the cover in a storage position when the lid is not in an operative position blocking an orifice on the cover. Because the posts are on the top of the cover, any chemotherapy waste which may have splashed onto the lid while in its operative position will drip onto the cover and not into the surrounding environment. The cover, including the posts, is easy and inexpensive to manufacture. The posts are also convenient and easy to use, assuring that persons using the cover will place the lid on the posts while accessing the waste container.

DETAILED DESCRIPTION OF THE PREFERRED EMBODIMENT

Figure 1:
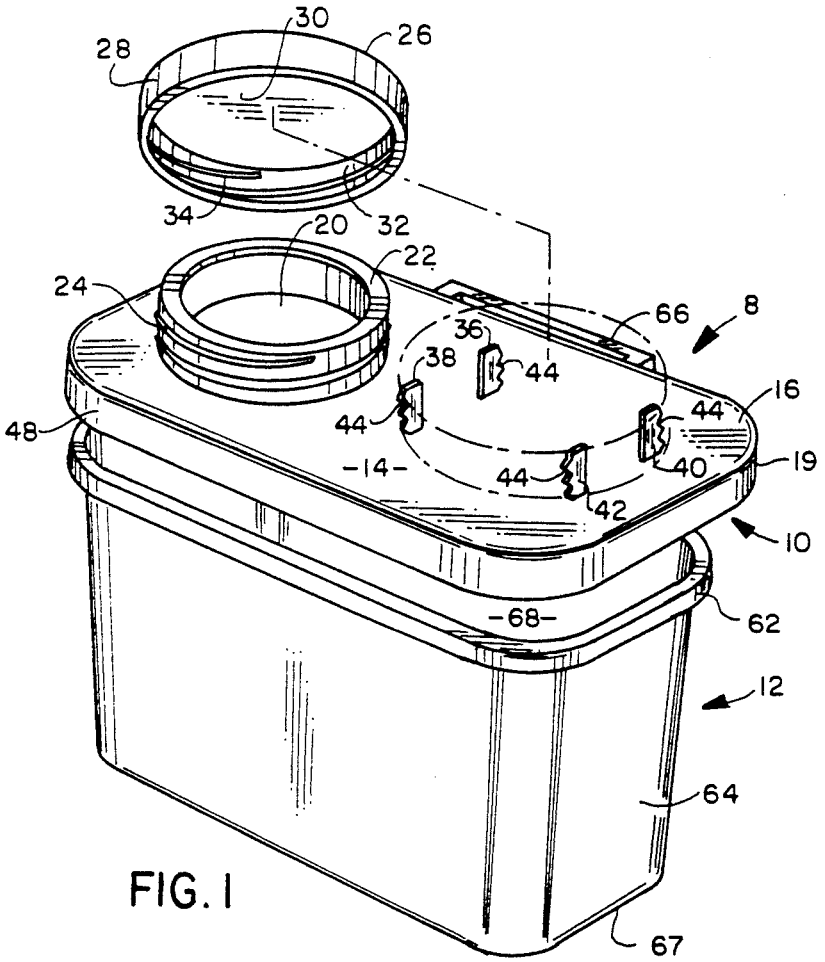
FIG. 1 is an exploded perspective view of the chemotherapy waste container cover of the present invention and a waste disposal container upon which it is mounted.
Figure 4:
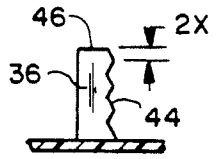
FIG. 4 is a sectional view of a lid engaging post taken along line 4—4 of FIG. 2.
Figure 5:
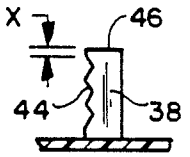
FIG. 5 is a sectional view of a lid engaging post taken along line 5—5 of FIG. 2.
Figure 6:
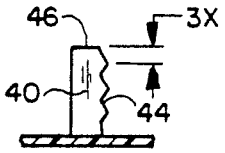
FIG. 6 is a sectional view of a lid engaging post taken along line 6—6 of FIG. 2.
Figure 7:
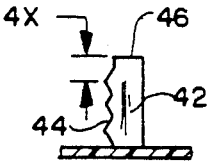
FIG. 7 is a sectional view of a lid engaging post taken along line 7—7 of FIG. 2.
Figure 2:
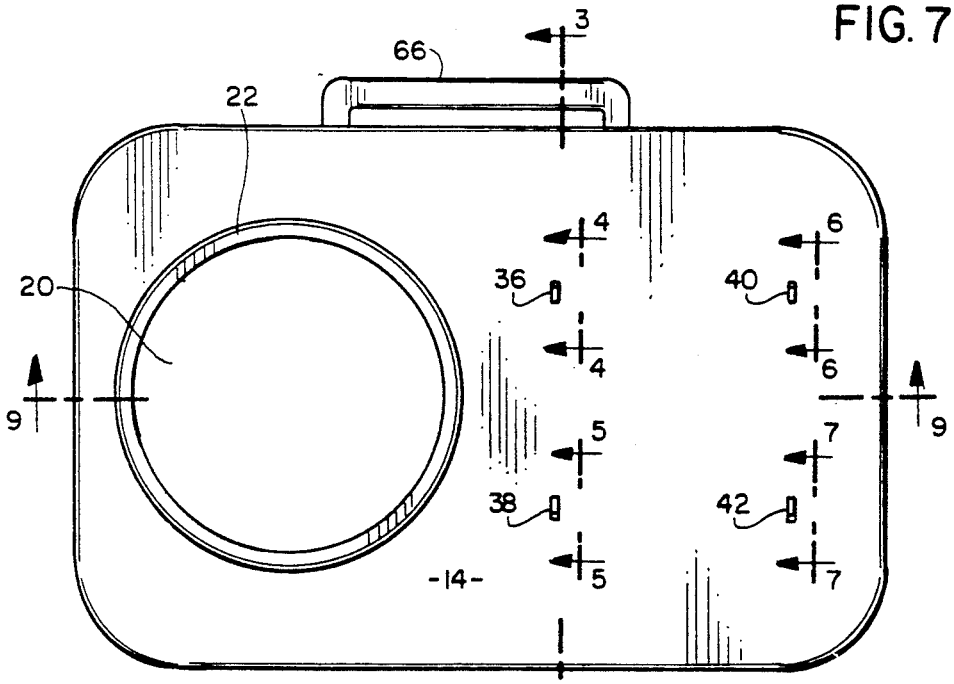
FIG. 2 is a plan view of the chemotherapy waste disposal cover of the present invention.
Figure 3:
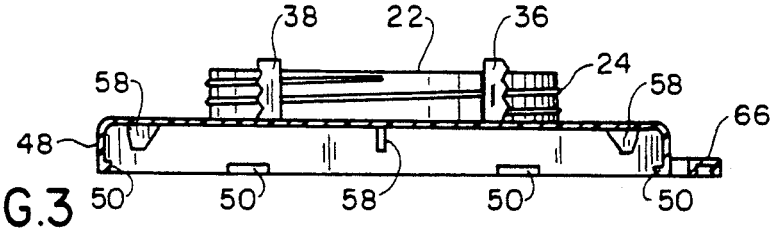
FIG. 3 is a side elevational view of the chemotherapy waste disposal cover of the present invention.

A chemotherapy waste receptacle 8 includes a chemotherapy waste container cover 10 configured to cover a chemotherapy waste container 12. The present invention concerns primarily the chemotherapy waste container cover 10. The cover 10 may be used to cover containers 12 for a variety of hazardous wastes or materials, although herein the primary focus of the invention is the use of the cover 10 as a cover for a chemotherapy waste container.

The cover 10 consists of a substantially planar rectangular body 14 having a top 16, a bottom 18 and a peripheral edge 19. The rectangular body 14 further includes an orifice 20 for permitting access to the waste container 12 upon which the cover 10 is disposed. An annular collar 22 extends upward from the top 16 of the rectangular body 14 around the periphery of the orifice 20. The annular collar 22 has external threads 24.

A lid 26 has a downward extending annular side wall 28 and a circular top wall 30. Disposed on the inside surface 32 of the downward extending annular side wall 28 are inward facing internal threads 34 configured to threadably engage the external threads 24 on the annular collar 22. By tightly threadably engaging the external threads 24 on the annular collar 22 to the lid 26, the lid 26 may be removably attached to the body 14 in an operative position forming a liquid and air tight seal.

A plurality of posts 36,38,40,42 extend upwardly from the top 16 of the rectangular body 14 for releasably holding the lid 26 in a storage position when it is not engaged on the collar 22. In the preferred embodiment, four posts 36,38,40,42 extend from the top 16 of the rectangular body 14, although any number of posts may be suitable. The posts 36,38,40,42 are spaced from each other such that they may releasably engage the inside surface 32 of the annular side wall 28 of the lid 26 when it is placed over the posts 36,38,40,42 and pushed towards the rectangular body 14 of the cover 10 as illustrated in FIG. 1.

FIGS. 4–7 illustrate the posts 36,38,40,42 in detail. Each of the posts 36,38, 40,42 have a plurality of teeth 44. The teeth 44 are configured to engage the internal threads 34 of the lid 26. As disclosed herein, the teeth 44 are spaced at different multiples of a distance X from the top 46 of the posts 36,38,40,42. In this manner the internal threads 34 of the lid 26 may threadably engage the teeth 44 of the posts 36,38,40,42. The present invention also contemplates that the teeth 44 are not spaced at different multiples of distance X and are configured to hold the lid 26 in place by frictional engagement of the threads as opposed to threaded engagement.

Figure 8:
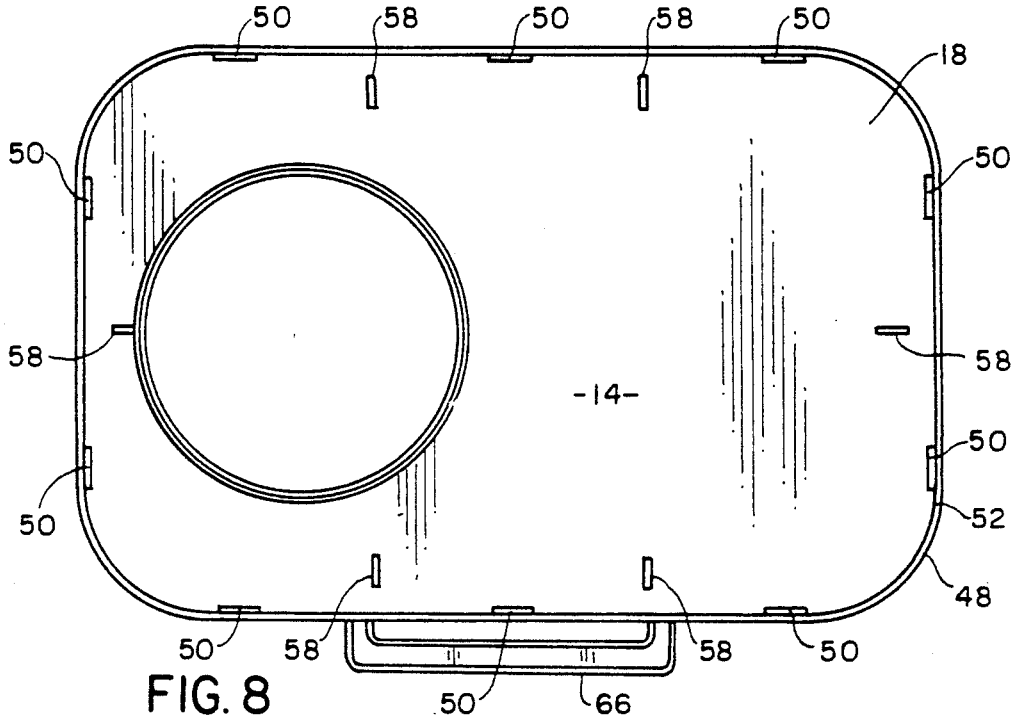
FIG. 8 is a bottom view of the chemotherapy waste container cover of the present invention.
Figure 9:
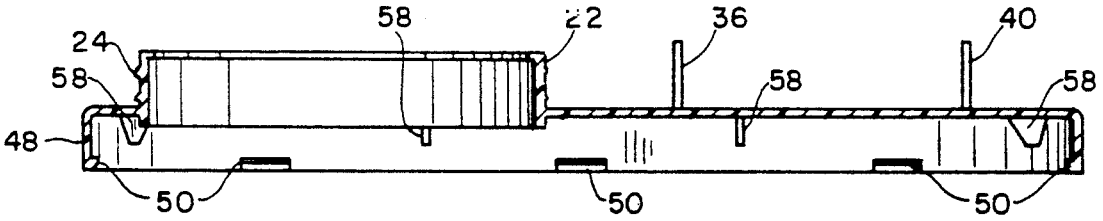
FIG. 9 is a sectional view of the chemotherapy waste container cover of the present invention taken along line 9—9 of FIG. 2.
Figure 10:
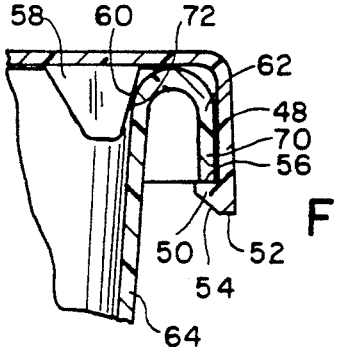
FIG. 10 is an enlarged sectional view illustrating the chemotherapy waste container cover of the present invention engaging a downward turned rim of a chemotherapy waste container.

A lip 48 extends downward from the periphery of the rectangular body 14. As best illustrated in FIGS. 8–10, the lip 48 has a plurality of inward projecting flanges 50 spaced essentially equidistance about the bottom 52 of the lip 48. The flanges 50 include a beveled surface 54 and a rim engaging surface 56.

Spaced between colinear inward projecting flanges 50 are bumpers 58. As illustrated in FIG. 10, the bumpers 58 are spaced a distance from the downward extending lip 48 such that a downward turned rim 62 of a side wall 64 of a waste container 12 can be forcibly inserted therebetween. The outward facing surface 60 of the bumper 5 is inclined to facilitate insertion of the downward turned rim 62 between the downward extending lip 48 and the bumper 58.

A handle 66 extends from the exterior of the downward extending lip 48.

Preferably, the cover 10, including the annular collar 22, the posts 36,38,40,42, the downward extending lip 48, the bumpers 58 and the handle 66 are integrally injection or blowmolded from an appropriate lightweight and inexpensive plastic. The plastic preferably is one which will incinerate without emission of harmful or toxic fumes. Polyethylene and polypropylene have been found to be acceptable plastics. Preferably, the plastic of which the cover 10 is integrally formed is translucent or transparent so that the level of waste within the container 12 upon which the cover 10 is disposed can be easily viewed. The lid 26 is preferably integrally injection or blowmolded from a plastic identical to that of cover 10.

The cover 10 is intended for use with a waste container 12 having a side wall 64, a bottom wall 67 and an open top 68. The open top 68 is defined by the downward turned rim 62 on the side wall 64. This is a configuration of many commercially available waste containers. Thus, the cover 10 does not require a special container, but rather can be designed to fit many commercially available waste containers. The rectangular body 14 of the cove 10 is configured to cover the opening 68 of the waste container 12. In the specific embodiment disclosed herein, the cover 10 is rectangular. However, the cover can be of any shape necessary to fit on the opening 68, for example square or round.

The cover 10 may be essentially permanently attached to the waste container 12 by aligning the downward extending lip 48 over the downward turned rim 62 of the container 12. The cover is then forced downward over the downward turned rim 62. The beveled surfaces 54 of the flanges 50 are configured to easily slide over the forward portion 70 of the downward turned rim. When seated on the waste container 12, the outward facing surface 60 of the bumper 58 engages the rearward portion 72 of the downward turned rim 62. The downward turned rim 62 is thereby grasped and locked between the rim engaging surface 56 of the flange 50, the downward extending lip 48 and the outward facing surface 60 of the bumper 58. When the cover 10 and the waste container 12 are thusly interengaged, the cover 10 cannot be removed from the container 1 without considerable effort and without destroying the cover 10 or the container 12. Moreover, an airtight and liquid-tight seal is formed between cover 10 and the container 12 for keeping the chemotherapy waste and vapors confined in the receptacle 8.

The structure for attaching the cover 10 to the waste container 12 disclosed herein facilitates transportation and storage of the chemotherapy waste receptacles 8 because the containers 12 can be seated within each other during transportation and storage, reducing the bulk of the receptacles 8. When desired, the containers 12 can be unseated and assembled as described above into receptacles 8. Once assembled, a receptacle 8 is for all practical purposes a permanently assembled and sealed structure.

While the present invention contemplates the specifically disclosed structure for attaching the cover 10 to the waste container 12, it should be understood that the invention may be practiced with other configurations for attaching the cover 10 to the waste container 12, provided that the structure renders it virtually impossible to remove the cover 10 from the waste container 12 without damaging one or the other and provides a liquid and air tight seal.

Once the cover 10 has been attached to the waste container 12, Waste may be poured into the waste container 12 by unscrewing the lid 26. The lid 26 may be releasably held and stored on the top of the cover 12 by fitting it over the posts 36,38,40,42 and pushing the lid 26 toward the cover 10 or screwing it downward. The lid may be removed from the posts by pulling it upward and away from the cover or unscrewing it. The lid can then be threadably secured to the collar 22 sealably closing the orifice 20.

Because the cover 10 is essentially permanently engaged to the container 12, one can remove the lid 26 from the cover without fear of disengaging the cover 10 from the container 12. Preferably, the posts are positioned such that the teeth 44 engage the internal threads 34 of the lid 26 tightly enough to hold the lid thereon, but not so tightly that removal is excessively difficult.

The chemotherapy waste container cover 10 of the present invention permits a chemotherapy waste receptacle 8 to be readily transported and stored and then assembled on site. The cover 10 provides a liquid and air tight seal to a container 12 to confine chemotherapy waste therein. The posts 36,38,40,42 provided on the top 16 of the cover 10 permit the lid 26 to be securely held to the top 16 of the cover 10 when the lid 26 is not closing the orifice 20. In this manner, the lid 26 may be maintained with the receptacle 8 in a position where any chemotherapy waste which may have splashed onto the lid 26 will not drip into the surrounding environment. Once the lid 26 is secured to the posts 36,38,40,42, a user has both hands free to dispose of wastes. Thus, safety and convenience are facilitated. Finally, the chemotherapy waste container cover 10 of the present invention is simple to use, and easy and inexpensive to manufacture.

What is claimed is:

1. A cover for placement over an opening defined by a waste disposal container, the cover comprising:

a body configured to cover an opening defined by a waste disposal container, the body having an orifice therethrough for permitting access to a waste disposal container upon which the cover is placed;

a lid;

cooperating means on the body and lid for threadably removably attaching the lid to the body in an operative position in which the lid blocks the orifice; and means on the body for releasably holding the lid in a fixed storage position on the body when the lid is not in its operative position on the body.

2. The cover of claim 1 wherein the means on the body for releasably holding the lid in a storage position comprises at least one post, the lid being engaged to the post by aligning the lid with the post and pushing the lid toward the body.

3. The cover of claim 1 wherein the cooperating means on the body and lid for threadably removably attaching the lid to the body comprises an upward extending, outward threaded annular collar around a periphery of the orifice and a cooperating internally threaded downward extending annular wall on the lid.

4. The cover of claim 3 wherein the means on the body for releasably holding the lid in a storage position comprises at least one post, the post having teeth for engaging the internal threads of the downward extending annular wall on the lid.

5. The cover of claim 4 wherein the teeth of the post are configured to threadably engage the internal threads of the downward extending annular wall on the lid.

6. The cover of claim 4 wherein the means on the body for releasably holding the lid in a storage position comprises a plurality of posts arranged to cooperatively hold the lid, each post having teeth, the posts being configured to cooperatively threadably engage the internally threaded downward extending annular wall on the lid.

7. A cover for placement over an opening defined by a waste disposal container having a side wall and a bottom wall, the side wall defining the opening, the cover comprising:

a body having a top and a bottom and a peripheral edge, the peripheral edge substantially conforming to an opening defined by a side wall of a waste disposal container, the body having an orifice therethrough for permitting access to a waste disposal container upon which the cover is placed;

an upward extending annular outward threaded collar on the top of the body portion surrounding the orifice;

a lid having a top wall and downward extending internally threaded annular wall for threadably engaging the threaded collar to attach the lid to the body in an operative position blocking the orifice;

means on the body for releasably holding the downward extending internally threaded annular wall of the lid in a storage position on the body when the lid is not in its operative position on the body to prevent inadvertent separation of the lid from the body.

8. The cover of claim 7 wherein the body includes means for cooperatively grasping a side wall of a waste disposal container.

9. The cover of claim 8 wherein the means for cooperatively grasping a side wall of a waste disposal container comprises a downward extending lip around the peripheral edge of the body, the lip having at least one inward projecting flange thereon for engaging a forward portion of a downward turned rim on a waste container, the means for cooperatively grasping further including a plurality of bumpers extending downward from the bottom of the body, the bumpers being configured to engage a back portion of a downward turned rim on a waste container so that when the cover is placed on a waste disposal container having a downward turned rim, a downward turned rim is secured between the downward extending lip, the inward projecting flange and the bumper to form a liquid and air tight seal therebetween.

10. The cover of claim 7 wherein the means for releasably holding the downward extending internally threaded annular wall of the lid when the lid is in a storage position comprises at least one post, the lid being engaged to the post by fitting the lid over the post and pushing the lid toward the cover.

11. The cover of claim 10 wherein the post has teeth for cooperatively engaging the internal threads of the lid.

12. The cover of claim 11 wherein the teeth of the post are configured to threadably engage the internal threads of the lid.

13. The cover of claim 7 wherein the means for releasably holding the downward extending internally threaded annular wall of the lid in a storage position comprises a plurality of posts spaced to engage the internally threaded annular wall of the lid, the posts having teeth which cooperatively engage the threads of the internally threaded lid, the lid being engaged to the plurality of posts by fitting the lid over the posts and pushing the lid toward the body.

14. The cover of claim 13 wherein the teeth of the post are configured to threadably engage the downward extending internally threaded annular wall of the lid.

15. A chemotherapy waste receptacle comprising:

a container having a side wall and a bottom wall, the side wall defining an opening;

a cover having a top and a bottom and a peripheral edge, the peripheral edge substantially conforming to the opening defined by the side wall, the cover having an orifice therethrough for permitting access to the container when the cover is placed thereon;

a lid separable from the cover;

an upward extending, outward threaded annular collar around a periphery of the orifice and a cooperating internally threaded downward extending annular wall on the lid for threadably removably attaching the lid to the cover in an operative position in which the lid blocks the orifice;

means on the cover for releasably holding the lid in a storage position on the cover when the lid is not in its operative position on the cover; and cooperating means on the peripheral edge of the cover and the side wall of the container for forming an air and liquid tight seal between the cover and the side wall of the container.

16. A waste disposal container comprising:

a housing defining a waste receptacle having a surface;

an orifice in the surface permitting access to an interior of the housing;

a lid;

cooperating means on the surface and on the lid for threadably removably attaching the lid to the housing in an operative position in which the lid blocks the orifice; and means on the housing for holding the lid in a fixed storage position on the housing when the lid is not in its operative position.

17. A waste disposal container of claim 16 wherein the holding means comprises:

the lid having an interior and an exterior; and means for making point contact with the interior of the lid, the lid being engaged to the point contact means by aligning the interior of the lid with the point contact means and pushing the lid toward the housing.

18. The waste disposal container of claim 17 wherein the point contact means comprises:

at least one post; and a plurality of post edges each engaging the interior of the lid and cooperating to hold the lid to the housing.

19. The waste disposal container of claim 17 wherein the point contact means comprises:

threads on the interior of the lid; and a plurality of posts, each post having teeth configured to engage the threads on the interior of the lid.

20. The waste disposal container of claim 19 wherein the point contact means comprises:

the teeth of the posts configured to threadably engage the threads on the interior of the lid.

* * * * *